US007017508B2

(12) United States Patent
Vanmoor

(10) Patent No.: US 7,017,508 B2
(45) Date of Patent: Mar. 28, 2006

(54) HYDRODYNAMICALLY AND AERODYNAMICALLY OPTIMIZED LEADING AND TRAILING EDGE CONFIGURATIONS

(76) Inventor: Arthur Vanmoor, 22 SE. 4th St., Boca Raton, FL (US) 33432

( * ) Notice: Subject to any disclaimer, the term of this patent is extended or adjusted under 35 U.S.C. 154(b) by 430 days.

(21) Appl. No.: 10/269,584

(22) Filed: Oct. 11, 2002

(65) Prior Publication Data

US 2004/0007149 A1 Jan. 15, 2004

Related U.S. Application Data

(63) Continuation-in-part of application No. 10/194,739, filed on Jul. 12, 2002.

(51) Int. Cl.
*B63G 8/04* (2006.01)
*B61D 17/00* (2006.01)

(52) U.S. Cl. ..... 114/312; 105/1.1

(58) Field of Classification Search ..... 102/501, 102/503, 504, 508, 509, 517, 518, 519, 439; 105/1.1; 114/312; 244/119, 125
See application file for complete search history.

(56) References Cited

U.S. PATENT DOCUMENTS

| | | | | | |
|---|---|---|---|---|---|
| 406,804 | A | * | 7/1889 | Weems | 105/1.3 |
| 452,741 | A | * | 5/1891 | Weems | 105/1.3 |
| 513,268 | A | * | 1/1894 | Kirchner et al. | 105/74 |
| 1,039,345 | A | * | 9/1912 | Winterros | 244/45 R |
| 1,150,650 | A | * | 8/1915 | Williams | 244/125 |
| 1,298,487 | A | * | 3/1919 | Flower | 244/125 |
| 1,656,137 | A | * | 1/1928 | Bradford | 244/125 |
| 1,705,346 | A | * | 3/1929 | Traver | 244/125 |
| 1,729,925 | A | * | 10/1929 | Bradford | 244/97 |
| 3,455,523 | A | * | 7/1969 | Hertel | 244/55 |
| 3,662,554 | A | * | 5/1972 | De Broqueville | 60/202 |
| 4,572,077 | A | * | 2/1986 | Antoine et al. | 102/439 |
| 4,932,306 | A | * | 6/1990 | Rom | 89/8 |
| 5,050,523 | A | * | 9/1991 | Schwemin et al. | 114/259 |
| D343,439 | S | * | 1/1994 | Kuczewski | D22/116 |
| 6,330,865 | B1 | * | 12/2001 | Cran | 114/74 T |
| 6,439,126 | B1 | * | 8/2002 | Kennedy et al. | 102/516 |
| 6,439,148 | B1 | | 8/2002 | Lang | |

FOREIGN PATENT DOCUMENTS

| | | | |
|---|---|---|---|
| DE | 3936645 | * | 5/1990 |
| GB | 0002236 | * | 6/1911 |
| JP | 3-271060 | * | 12/1991 |
| JP | 5-124511 | * | 5/1993 |

* cited by examiner

*Primary Examiner*—Peter M. Poon
*Assistant Examiner*—David J. Parsley
(74) *Attorney, Agent, or Firm*—Laurence A. Greenberg; Werner H. Stemer; Ralph E. Locher

(57) ABSTRACT

A novel concept for a hydrodynamically and aerodynamically improved leading edge and trailing edge structure is primarily suited for high-speed motion, such as near Mach 1 and above, but also for slow-speed motion and for stationary operation, where stationary structures are subjected to fluid flow. The configuration incorporates the model of the natural wave behavior. The leading edge of the aircraft, of the train, of the submarine, or the like, has a sharp tip which merges smoothly into a cylindrical or rectangular body. The merging segment from the tip to the cylinder may be defined with a tangent function. The rounding of the surfaces promote proper fluid sheet formation along the surface and to reduce undesirable vortice formation and thus to reduce the value of several drag factors.

7 Claims, 3 Drawing Sheets

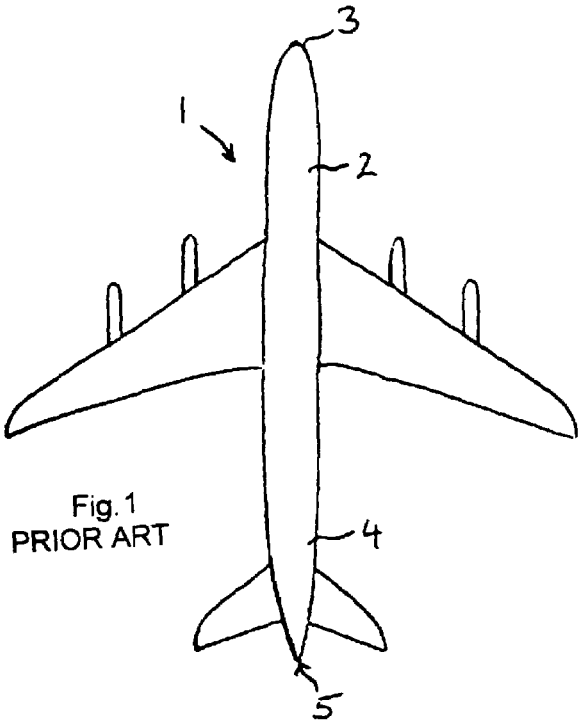
Fig. 1
PRIOR ART
Fig. 3
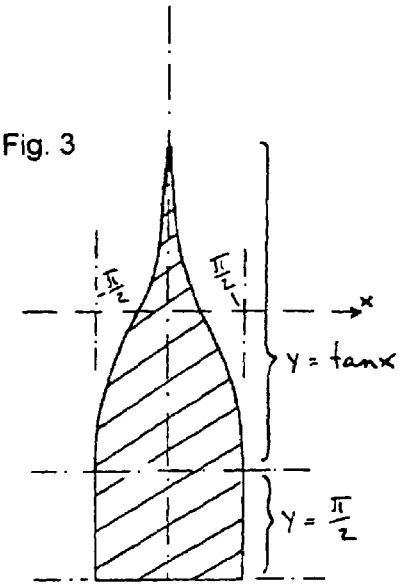
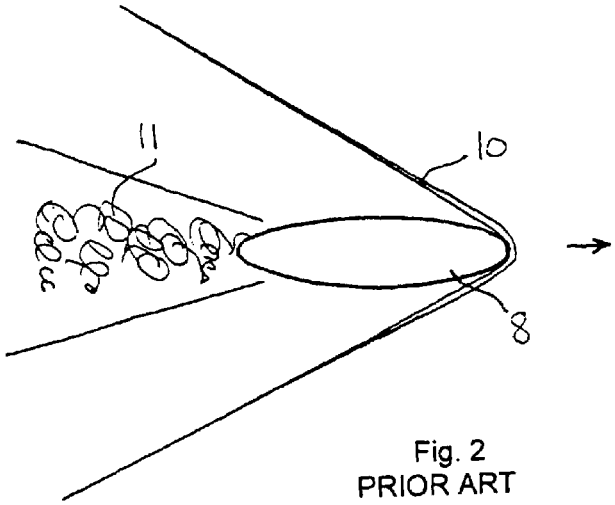
Fig. 2
PRIOR ART

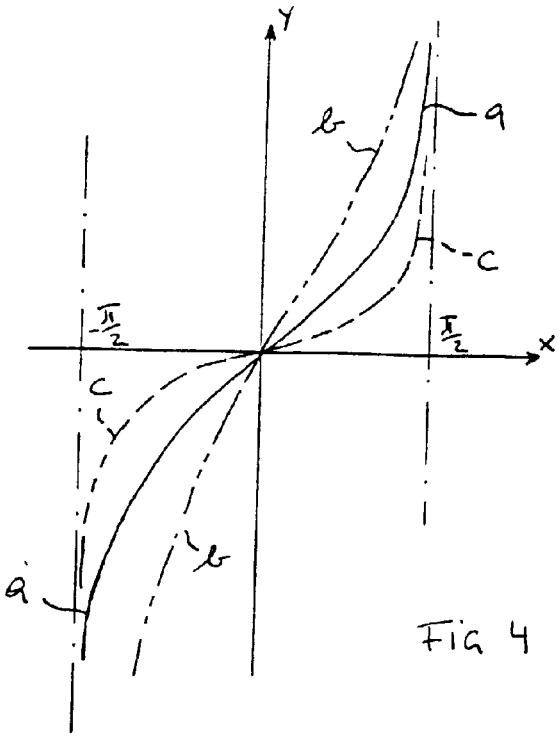
FIG 4
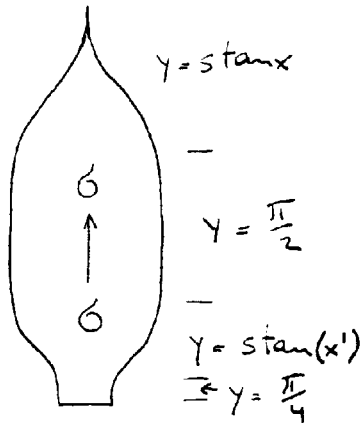
FIG 6
FIG. 5
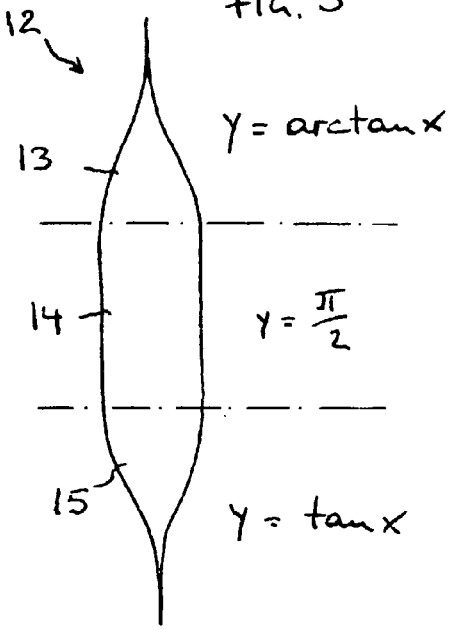

HYDRODYNAMICALLY AND AERODYNAMICALLY OPTIMIZED LEADING AND TRAILING EDGE CONFIGURATIONS

CROSS-REFERENCE TO RELATED APPLICATIONS

The application is a continuation-in-part of my copending application Ser. No. 10/194,739, filed Jul. 12, 2002, and entitled Projectile With Improved Dynamic Shape.

BACKGROUND OF THE INVENTION

FIELD OF THE INVENTION

The invention lies in the field of fluid dynamics. In particular, the invention pertains to structures with novel aerodynamic and hydrodynamic shapes, specifically with novel leading and trailing edge structures. The configurations are applicable to moving objects and to stationary objects.

A variety of factors influence the dynamic behavior of fast-moving structures and projectiles. First and foremost, the pressure of the carrier medium at the bow establishes the primary drag factor. In the case of atmospheric flight—generally referred to as aerodynamics—the pressure of the atmosphere causes a shock wave that resists the flight of the object. The next drag factor is the skin friction. Flight inefficiency is affected by micro-friction between the exposed surfaces and the innermost layer (flow sheet) of the fluid impinging and being deflected by the surfaces. Surface roughness and minor convolutions on the surface are detrimental factors. Third, the base drag is the energy that is lost from the kinetic energy of the projectile to form turbulence flows at the rear of the projectile.

Similar considerations apply to hydrodynamic applications. There, a large part of the energy required to propel a structure is lost in so-called hydrodynamic drag. Such drag has two primary components, namely, frictional drag and wavemaking (water displacement) or induced (drag induced by the lift of the craft). Reducing the hydrodynamic drag of a craft translates directly into savings in terms of energy losses.

U.S. Pat. No. 6,439,148 B1 to Lang describes a low-drag, high-speed ship which, for military transport applications, is suitable to travel at speeds in excess of 100 knots. Lang is primarily concerned with measures for reducing the frictional drag of water-immersed components of the craft. Lang discloses that it is advantageous for the tail end of hydrodynamic craft to merge from the main hull to the tail by first bulging outwardly, then reducing the width from the bulge along an inward curve, and then to progressively flatten out to lead to a relatively narrow lance tip at the trailing end of the craft. Lang proposes the novel tail piece only in the context of avoiding or reducing cavity drag of a hydrofoil.

SUMMARY OF THE INVENTION

It is accordingly an object of the invention to provide a novel shape for leading and trailing edge structures of objects that are subject to aerodynamic and hydrodynamic constraints, which alleviates the above-mentioned disadvantages of the heretofore-known devices of this general type and which proposes a novel principle in leading and trailing shape design that further minimizes drag in a wide range of travel velocities and transport medium densities.

With the foregoing and other objects in view there is provided, in accordance with the invention, a dynamically optimized structure, comprising:

a body segment;

a tip segment adjoining the body segment and smoothly merging from the body segment to a tip, the tip segment being defined, at least in one section, by a function y=s tan x, where x and y are Cartesian coordinates and y extends parallel to a longitudinal axis of the body segment, and s is a real number greater than zero.

In accordance with an added feature of the invention, the body segment is substantially cylindrical in a section orthogonal to the center axis, and the tip segment is defined by the function y=s tan x in a multitude of sections through the center axis.

In a preferred embodiment of the invention, s is a constant and s may be a number greater than 1. Also, s may be a function of x and it may have a maximum value smaller than a maximum value of x.

In accordance with an additional feature of the invention, the structure also has a tail segment adjoining the body segment opposite from the tip segment and smoothly merging from the body segment to a tail. The tail segment is defined, in at least one section through the center axis, by a function mirroring the function y=s tan x of the tip segment.

If the body is cylindrical, then both the tip segment and the tail segment are rotationally symmetrical about the center axis. That is, the tip segment and the tail segment are each defined by the function y=s tan x in a multitude of sections through the center axis.

With the above and other objects in view there is also provided, in accordance with the invention, an aerodynamically optimized aircraft body, comprising:

a body segment having a center axis and a substantially round periphery;

a nose segment adjoining the body segment and smoothly merging from the body segment to a tip, the tip segment being defined, at least in one section, by a function y=s tan x, where x and y are Cartesian coordinates and y extends parallel to the center axis, and s is a real number greater than zero.

Similarly to the above explanation, the aircraft body has a tail segment adjoining the body segment opposite from the tip segment and smoothly merging from the round body segment to a tail, the tail segment being defined, in at least one section through the center axis, by a function mirroring the function y=s tan x of the tip segment.

With the above and other objects in view there is also provided, in accordance with the invention, an aerodynamically optimized train structure and a hydrodynamically improved underwater craft.

The novel concept is primarily suited for supersonic flight and sub-sonic, fast flight in air. It is applicable for aircraft, rockets, grenades, and the like. The concept is also suited for travel in higher-pressure media, such as water. It is thus applicable for boat hulls, partial hulls, submarines, torpedoes, and the like. Finally, the novel configuration is also suitable for stationary applications where the structure is stationary and it is exposed to the motion of a fluid. The configuration incorporates the model of the natural wave behavior. The leading edge of the novel structure has a sharp tip which merges smoothly into a flat body, a cylindrical body, or a mixture thereof. The merging segment from the tip to the cylinder may be defined with a tangent function. The rounding of the surfaces promote proper fluid sheet formation along the surface and to reduce undesirable vortice formation and thus to reduce the value of several drag factors.

Other features which are considered as characteristic for the invention are set forth in the appended claims.

Although the invention is illustrated and described herein as embodied in a novel leading and trailing edge shape for traveling craft and projectiles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a plan view of an airplane with a prior art fuselage and airfoil shape;

FIG. 2 is a wind tunnel diagram illustrating the aerodynamic behavior of a prior art projectile;

FIG. 3 is a sectional view of a solid structure with a leading or trailing end according to the invention;

FIG. 4 is a diagram illustrating various functions to circumscribe the tip and/or tail segment of the novel dynamically improved shape;

FIG. 5 is a diagrammatic plan view of a novel fuselage embodiment or a submarine shape according to the invention;

FIG. 6 is a diagrammatic view of a projectile with the leading structure according to the invention and a modified tail end shape.

DESCRIPTION OF THE PREFERRED EMBODIMENTS

Figure 7:
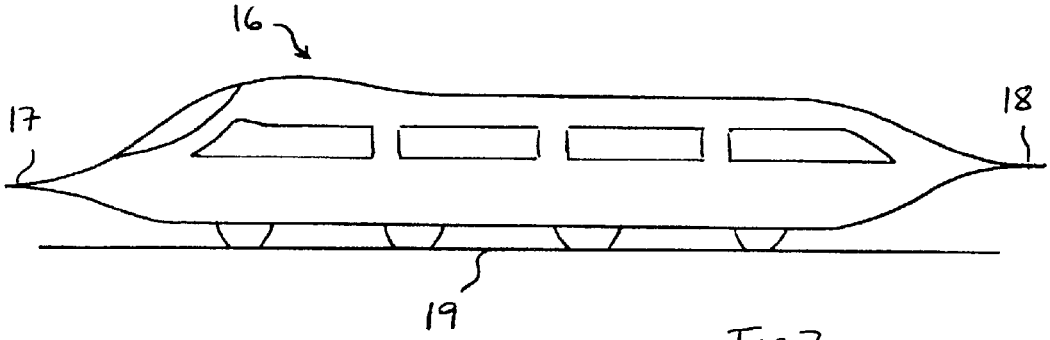
FIG. 7 is a diagrammatic side view of a bullet train with an improved leading and trailing shape according to the invention.

Referring now to the figures of the drawing in detail and first, particularly, to FIG. 1 thereof, there is seen an airplane 1. The airplane 1 has a fuselage 2 with a rounded forward end 3 and a rear end 4, which merges into a moderate tip 5. The fuselage 2 is generally rotationally symmetrical about its longitudinal axis, or it may be slightly elliptical with its major axis along a vertical.

The shape of the body of the plane 1 illustrated in FIG. 1 is representative of the typical shape for current state of the art aircraft. Typical modifications include a more pronounced leading tip 3, such as for supersonic aircraft, and for rockets, and/or a more pronounced trailing tip 5.

Referring now to FIG. 2, the resistance to flight of a generally bullet-shaped structure is best illustrated in a wind tunnel diagram. Here, the object 8, which may be the fuselage 2, is subject to a conical forward shockwave 10.

The forward shockwave is an atmospheric disturbance which occurs essentially only in supersonic flight. At the speed of sound, Mach 1, the shockwave 10 is approximately flat and perpendicular to the flight path. As the flight speed increases, the shockwave bends backward to become flatter along the object contour. The cone angle is inversely proportional to the speed of the projectile. For example, at a speed of Mach 1.4, the shockwave has an apex angle of approximately 90° and at Mach 2.4 the apex angle in front of the projectile is approximately 50°.

The second important drag factor is the energy loss due to the tail turbulence 11 behind the projectile. In subsonic flight, this is the primary drag factor. These losses remain substantially constant within a wide speed range and well into the supersonic range.

The third drag factor is referred to as skin friction. Surface roughness and minor convolutions on the body of the projectile have a negative influence on the projectile flight.

Referring now to FIG. 3, there is illustrated a leading end of an aerodynamically improved structure according to the invention, such as a fuselage 2 with a novel forward shape. The structure is illustrated with a solid body for reasons of clarity. It will be understood, however, that the description equally applies to jacketed, partly jacketed, or hollow body structures. The forward shape, in the illustrated section, can be defined in geometric terms by a tan function (and/or an arctan function). As shown, the rotationally symmetric shape has a tip that is modeled as $y=\tan x$ rotated about its terminal limit $\pi/2$ or $-\pi/2$. The tip is followed by a cylindrical segment $y=\pi/2$.

Depending on the application and the maximized speed behavior of the structure, the forward tip segment may be varied within a given range of designs. With reference to FIG. 4, the tip may be flattened by multiplying the envelope curve with a factor greater than 1 and made more pronounced with a factor less than 1. The curves a, b, and c are as follows:

a: $y=\tan x$ b: $y=s\cdot\tan x$ . . . $s>1$ c: $y=s\tan x$ . . . $s<1$.

Furthermore, the factor s may also be a function instead of a constant. That is, s can be defined as a function of x so that the "flattening" of the tip jacket varies. The function $s=f(x)$ can be maximized according to the respective application of the aerodynamic or hydrodynamic structure and in terms of ease of manufacture.

Referring now to FIG. 5, which illustrates an aircraft fuselage or a submarine, the shape may also be maximized with regard to its tail section. Instead of the flat tail, the fuselage 12 of FIG. 5 has the same tail shape as its tip. As illustrated, the fuselage 12 has three segments, namely, the forward tip segment 13 that follows the tangent function, a cylindrical middle segment 14, and a trailing tail segment 15 which again follows the tangent function. While the forward compression cone behavior of this embodiment may be the same as with the projectile of FIG. 3, the tail turbulence drag of the second embodiment is likely reduced in a wide range of speeds.

Referring now to FIG. 6, there is illustrated a further variation of the principles of the invention. Here, the tail segment is first reduced by a tangent function that sweeps a range of x that is about half of the x sweep of the tip segment. Following the tangent curve, the tail segment of the further embodiment ends in a small cylindrical segment. The latter may be described with a rotation, about the longitudinal axis of the fuselage, of a straight line $y=\pi/4$ or the like. More generally, the line can be described as $y=\pi/q$, where $0<q<2$.

FIG. 6 also illustrates a further feature of the invention which is applicable to bullets and similar projectiles: in order to provide for the center of gravity to be forward as far as possible, the density and/or weight and/or specific weight of the material becomes greater from the tail to the tip. That is, the center of gravity moves forward while the center of pressure—which is dictated only by the outline shape of the projectile—will have a tendency to remain behind the center of gravity. The result of this relationship is an increased stability of the projectile in static as well as dynamic terms.

With reference to FIG. 7, the invention is also suitable for lower speed applications than near Mach or above-Mach speeds. Latest generation bullet trains with speeds well in excess of 200 mph gain considerable aerodynamic advantages from the novel leading edge and trailing edge shapes. The first commercial Maglev (magnetic levitation) trains will begin operation in Shanghai in early 2004. Speeds of that system will exceed 300mph. Further Maglev systems with design speeds in excess of 400 mph are currently in development.

Especially in the case of the novel train shapes, but also in the context of aircraft and watercraft, the novel leading and trailing edges are not rotationally symmetrical about the longitudinal axis. That is, the main body of the train 16, for example, may be substantially square or rectangular in cross section. The leading edge 17 may thereby start from a needle tip and widen in four directions, up/down and towards both sides. In the alternative, the leading edge 17 may also be in the form of a blade (orthogonal to the plane of the drawing paper) and widen from the tip to the wheel-house only in two directions, similar to a duck's beak. Any variation between those two extremes, of course, is possible as well. The same holds true for the tail segment with its trailing edge 18. The train 16 is illustrated with a diagrammatic maglev structure 19.

It will be understood that, while much of the above description deals with aerodynamic principles, i.e., with the high-speed movement of objects through gaseous media, the invention is not limited to such aerodynamic movement. Instead, the invention also pertains to hydrodynamic principles and the relative movement of rigid structures and liquids.

I claim:

1. An aerodynamically optimized train structure, comprising:

a body segment having a substantially rectangular periphery and a longitudinal extent defining a travel direction of the train structure;

a tip segment adjoining said body segment and smoothly merging from said body segment to a tip, said tip segment being symmetrically defined, at least in a vertical section, by a function y=s tan x on one side and y=−s tan x on an opposite side, where x and y are Cartesian coordinates and y extends parallel to said longitudinal extent, and s is a real number greater than zero.

2. The train structure according to claim 1, wherein the functions y=s tan x and y=−s tan x are defined by a substantially horizontal section.

3. The train structure according to claim 1, wherein the tip segment is substantially rotationally symmetric about a longitudinal axis of the train structure.

4. A hydro-dynamically optimized hull structure, comprising:

a body segment to be at least partially submerged during an operation of the hull structure;

a tip segment adjoining said body segment and smoothly merging from said body segment to a tip, said tip segment being defined, at least in one section, by a function y=s tan x, where x and y are Cartesian coordinates, x extends in value substantially from pi/2 to −pi/2, y extends parallel to a direction from said body segment to said tip segment, and s is a real number greater than zero; and a tail segment adjoining said body segment opposite from said tip segment and smoothly merging from said body segment to a tail, said tail segment being defined, in at least one section through an axis connecting said tip to said tail, by a function mirroring the function y=s tan x of said tip segment.

5. The hull structure according to claim 4, wherein said body segment is substantially cylindrical in a section orthogonal to a longitudinal axis thereof, and said tip segment is defined by the function y=s tan x in a multitude of sections through said longitudinal axis.

6. The hull structure according to claim 5, wherein said body segment, said tip segment and a tail segment together form a submarine hull.

7. The hull structure according to claim 4, wherein said body segment is substantially cylindrical in a section orthogonal to said axis, said tail segment is defined by the function y=s tan x in a multitude of sections through said axis, and said body segment, said tip segment and said tail segment together form a hydrodynamically optimized submarine hull.

* * * * *